US007880567B2

(12) United States Patent
Hwang et al.

(10) Patent No.: US 7,880,567 B2
(45) Date of Patent: Feb. 1, 2011

(54) OVERLAY ELECTROMAGNETIC BANDGAP (EBG) STRUCTURE AND METHOD OF MANUFACTURING THE SAME

(75) Inventors: Cheol-gyu Hwang, Suwon-si (KR); Sung-tae Choi, Hwaseong-si (KR); Jung-han Choi, Hwaseong-si (KR); Young-hwan Kim, Hwaseong-si (KR); Dong-hyun Lee, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 277 days.

(21) Appl. No.: 12/034,260

(22) Filed: Feb. 20, 2008

(65) Prior Publication Data

US 2009/0096552 A1 Apr. 16, 2009

(30) Foreign Application Priority Data

Oct. 10, 2007 (KR) ..... 10-2007-0102266

(51) Int. Cl.
*H01P 1/203* (2006.01)

(52) U.S. Cl. ..... 333/205

(58) Field of Classification Search ..... 333/167, 333/168, 175, 185, 202, 204, 205, 238
See application file for complete search history.

(56) References Cited

U.S. PATENT DOCUMENTS

2007/0109076 A1* 5/2007 Knecht et al. ..... 333/204
2008/0272859 A1* 11/2008 Sangawa et al. ..... 333/205

FOREIGN PATENT DOCUMENTS

| | | | |
|---|---|---|---|
| EP | 1 302 999 | A1 | 4/2003 |
| JP | 05-275903 | A | 10/1993 |
| JP | 11-355010 | A | 12/1999 |
| JP | 2001-111303 | A | 4/2001 |
| JP | 2002-026611 | A | 1/2002 |
| KR | 10-2004-0071916 | A | 8/2004 |
| KR | 10-2004-0076658 | A | 9/2004 |
| KR | 10-2005-0043554 | A | 5/2005 |
| KR | 10-2006-0118062 | A | 11/2006 |

OTHER PUBLICATIONS

Machine (English) Translation of Lee et al, "Low Pass Filter Using New PBG Structure and Superhigh Frequency and Millimeter Wave Band Package Including the Same", Mar. 9, 2004.*

* cited by examiner

*Primary Examiner*—Benny Lee
*Assistant Examiner*—Gerald Stevens
(74) *Attorney, Agent, or Firm*—Sughrue Mion, PLLC

(57) ABSTRACT

Provided is an electromagnetic bandgap (EBG) structure, and particularly, an overlay EBG structure in which a plurality of vias and a plurality of plates are formed at intervals on a central signal line in such a manner that the vias and plates extend vertically from a substrate in order to reduce leakage loss of an electromagnetic wave through the substrate. Therefore, it is possible to prevent an electromagnetic wave passing through a transmission line from being lost through the substrate, to obtain desired frequency characteristics by adjusting the dimensions of the vias and plates, and to manufacture the overlay EBG structure using an existing CMOS process without having to perform any additional process.

17 Claims, 8 Drawing Sheets

OVERLAY ELECTROMAGNETIC BANDGAP (EBG) STRUCTURE AND METHOD OF MANUFACTURING THE SAME

CROSS REFERENCE TO RELATED APPLICATIONS

This application claims priority from Korean Patent Application No. 10-2007-0102266, filed on Oct. 10, 2007, the disclosure of which is incorporated herein in its entirety by reference.

BACKGROUND OF THE INVENTION

1. Field of the Invention

The present invention relates to an Electromagnetic Bandgap (EBG) structure, and more particularly, to an overlay Electromagnetic Bandgap (EBG) structure for reducing leakage loss of an electromagnetic wave through a substrate, and a method of manufacturing the same.

2. Description of the Related Art

With the development of information communication technologies, various communication devices have been developed and distributed. Also, to increase the number of communication channels and reduce the size of communication systems, various communication devices using high-band frequencies are being developed. Such communication devices essentially have a function of selecting or controlling a specific frequency. In general, a circuit for selecting or controlling a specific frequency is implemented by arranging lumped-type passive elements (for example, inductors or capacitors).

However, when a high frequency is used, a wavelength is shortened, and accordingly interference between communication lines becomes significant, so that each communication line operates as a circuit element. That is, since the number of unexpected components increase in a high frequency environment, a problem may occur when general passive elements are used in a microwave band (or in a millimeter wave band).

For this reason, research into developing passive elements capable of being used in a super high frequency band has been carried out. For example, a trial has been conducted to arrange existing lumped elements on the same plane to predict parasitic components in a high frequency environment. A remarkable structure is an electromagnetic bandgap (EBG) structure in which a photonic bandgap (PBG) structure for guiding photons is applied to a super high frequency area. The EBG structure is applied to various devices, such as a filter, a resonator, etc.

However, an existing EBG structure causes additional leakage loss of an electromagnetic wave through a substrate when a PBG is integrated into a flat integrated circuit, and the leakage loss deteriorates a band selection characteristic of a filter.

SUMMARY OF THE INVENTION

The present invention provides an Electromagnetic Bandgap (EBG) structure which can reduce leakage loss of an electromagnetic wave through a substrate and easily adjust frequency characteristics, and a method of manufacturing the same.

The EBG structure according to the present invention is implemented by providing an overlay EBG structure in which a plurality of vias and a plurality of plates are aligned at intervals on a central signal line of a substrate, and a manufacturing method thereof.

According to an aspect of the present invention, there is provided an overlay electromagnetic bandgap (EBG) structure including: a transmission line formed on a substrate, and transmitting a signal; a plurality of plates, each plate formed over and separated from the transmission line; and a plurality of vias, each via connecting a plate to the transmission line, wherein the plates and the vias are formed at predetermined intervals in a longitudinal direction of the transmission line.

Also, frequency characteristics of the overlay EBG structure are controlled by properly adjusting a dimension of the via or the plate. For example, the frequency characteristics of the overlay EBG structure are controlled by properly adjusting intervals between plates, dimensions of the plates, shapes of the plates, intervals between vias, thicknesses of the vias, etc.

The overlay EGB structure further includes a plurality of varactors respectively inserted between the plurality of plates, wherein frequency characteristics of the overlay EGB structure are controlled by the plurality of varactors.

Also, the overlay EBG structure is formed on both a front surface and a rear surface of the substrate.

According to an aspect of the present invention, there is provided a method of manufacturing an overlay electromagnetic bandgap (EBG) structure, including: depositing a first metal layer on a substrate to form a transmission line; applying an oxide film on the substrate and etching the oxide film to form a via hole for exposing the transmission line; and depositing a second metal line through the via hole to form a via extended from the transmission line and a plate connected to one end of the via.

The via and the plate are formed at predetermined intervals in a longitudinal direction of the transmission line.

Additional aspects of the invention will be set forth in the description which follows, and in part will be apparent from the description, or may be learned by practice of the invention.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the aspects of the invention.

DETAILED DESCRIPTION OF EXEMPLARY EMBODIMENTS

Figure 1:
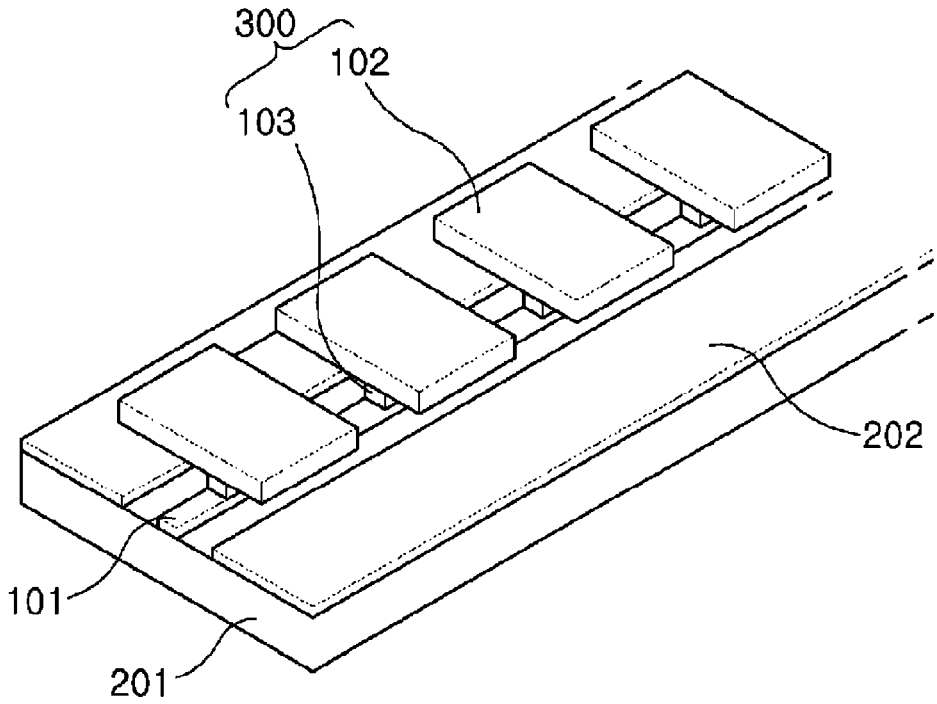
FIG. 1 is a perspective view of an overlay Electromagnetic Bandgap (EBG) structure according to an embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

Figure 2:
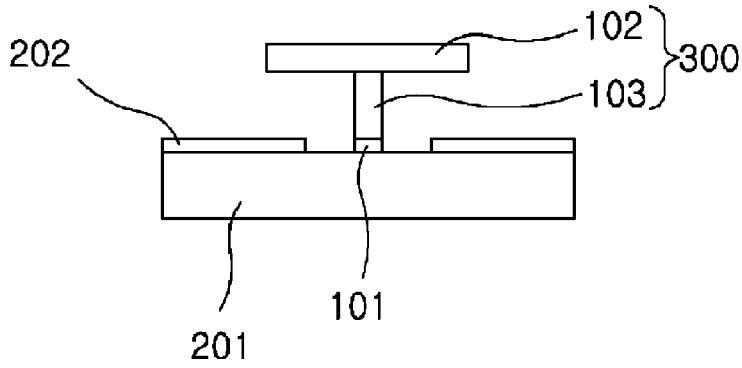
FIG. 2 is a front cross-sectional view of the overlay EBG structure illustrated in FIG. 1.
Figure 3:
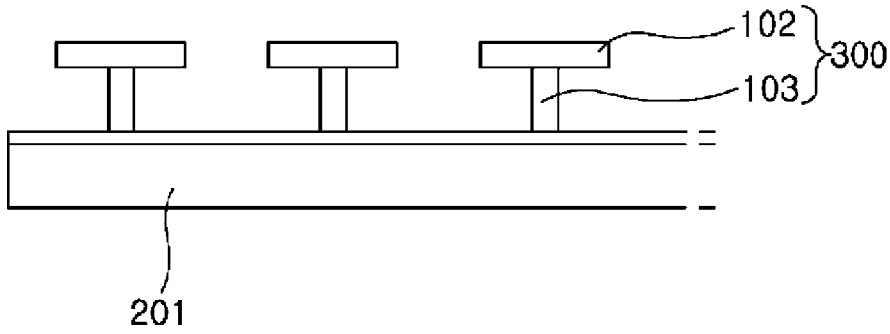
FIG. 3 is a side cross-sectional view of the overlay EBG structure illustrated in FIG. 1.
Figure 4:
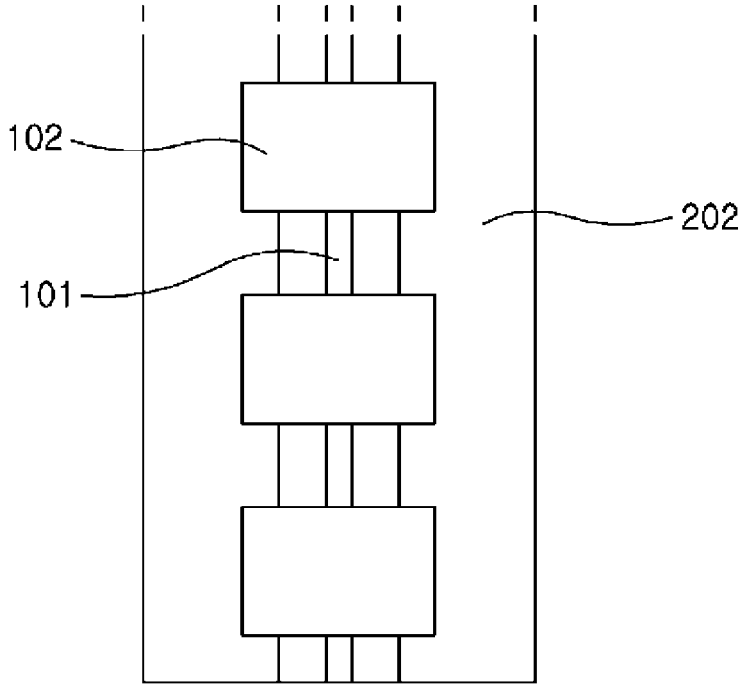
FIG. 4 is a plan view of the overlay EBG structure illustrated in FIG. 1.

FIG. 1 is a perspective view of an overlay Electromagnetic Bandgap (EBG) structure according to an embodiment of the present invention, FIG. 2 is a front cross-sectional view of the overlay EBG structure illustrated in FIG. 1, FIG. 3 is a side cross-sectional view of the overlay EBG structure illustrated in FIG. 1, and FIG. 4 is a plan view of the overlay EBG structure illustrated in FIG. 1.

Referring to FIGS. 1 through 4, the overlay EBG structure includes a transmission line 101, a plurality of plates 102, and a plurality of vias 103.

The transmission line 101 is formed on the substrate 201 and transmits signals. A signal passing through the transmission line 101 may be an electromagnetic wave having a high frequency. Also, the transmission line 101 may be a central signal line of a coplanar waveguide (CPW).

The plurality of plates 102 are formed over and separated from the transmission line 101. Each plate 102 may be a rectangle or a thin film, and is separated from the transmission line 101 and a ground plate 202. A portion of the plate 102 may face the ground plate 202 so that capacitance is formed between the plate 102 and the ground plate 202. Also, the plate 102 is made of the same material as that of the transmission line 101 so a signal can pass therethrough.

Each via 103 connects each plate 102 to the transmission line 101. That is, a via 103 is extended vertically from the transmission line 101 in such a manner that one end of the via 103 is connected to the center portion of the plate 102. The via 103 is made of the same material as that of the transmission line 101. Accordingly, the via 103 connects the transmission line 101 to the plate 102 so that signals can be transmitted between the transmission line 101 and the plate 102.

In an existing coplanar waveguide (CPW) structure, since an electric field for inducing electromagnetic waves is generated between a transmission line and a ground plate, there is a problem in that some of the electrical field is lost through the substrate 201. However, in the overlay EBG structure according to this embodiment of the present invention, since a major part of an electric field is generated vertically between the plate 102 and the ground plate 202, leakage loss through a substrate is reduced. Also, in order to apply the advantage of the overlay EBG structure to an existing EBG structure, the plate 102 and the via 103 form a single unit 300, and a plurality of units 300 are aligned at predetermined intervals in a longitudinal direction of the transmission line 101. Here, the plurality of units 300 may be aligned at regular or irregular intervals.

Furthermore, the dimensions (for example, intervals, sizes, thicknesses, etc.) of the units 300 can vary, and the overlay EBG structure according to the present invention can be used as a filter by properly adjusting the dimensions of the units 300. In this case, the frequency characteristics of the filter can be controlled by adjusting the dimensions of the plates 102 or vias 103.

Figure 5:
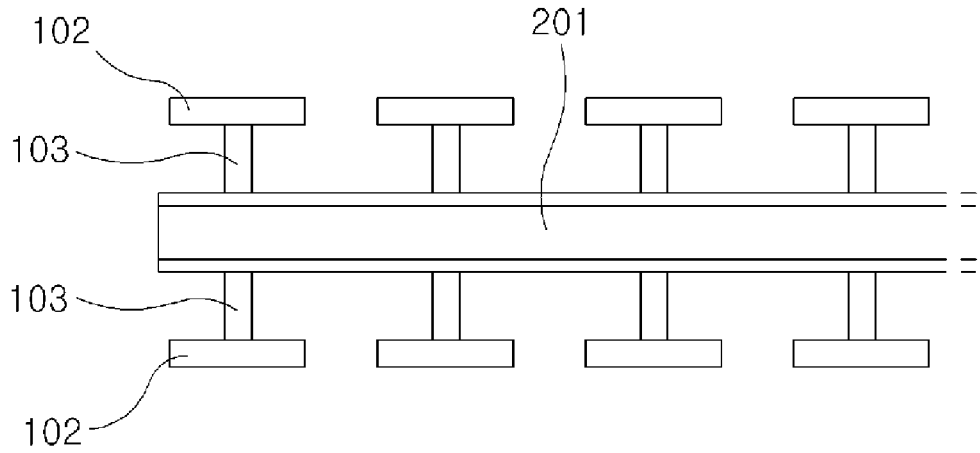
FIG. 5 illustrates a structure where two of the overlay EBG structures illustrated in FIG. 1 are coupled vertically, according to an embodiment of the present invention.

In the existing EBG structure, since predetermined cavities for setting frequency characteristics are arranged at regular intervals on a plane, an additional space for the cavities should be prepared. However, in the current embodiment of the present invention, since the units 300 are arranged vertically from the substrate 201, an additional space for the cavities can be reduced. In particular, as illustrated in FIG. 5, two overlay EBG structures respectively having plates 102 and vias 103 aligned therein may be coupled vertically with a substrate 201 in between.

Figure 6:
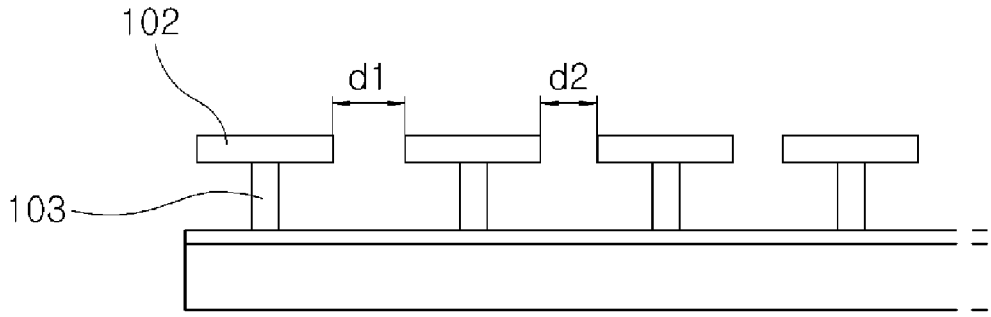
FIG. 6 illustrates an overlay EBG structure in which a plurality of plates are aligned at irregular intervals, according to another embodiment of the present invention.

FIG. 6 illustrates an overlay EBG structure in which a plurality of plates 102 are aligned at irregular intervals, according to another embodiment of the present invention. The overlay EBG structure illustrated in FIG. 6 can be applied to a filter.

Referring to FIG. 6, the plurality of plates 102, each connected to one end of a via 103, are aligned at irregular intervals (for example, $d_1 \neq d_2$). Since the frequency characteristics of the overlay EBG structure vary when the intervals between the plates 102 vary, frequency tuning is possible by varying the intervals between the plates 102. Also, in order to vary the intervals between the plates 102, intervals between vias 103 can be properly adjusted.

Figure 7:
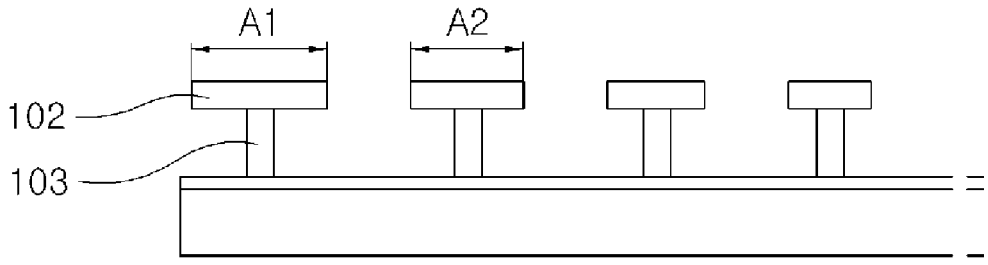
FIG. 7 illustrates an overlay EBG structure in which a plurality of plates having different sizes are aligned, according to another embodiment of the present invention.

FIG. 7 illustrates an overlay EBG structure in which a plurality of plates 102 having different sizes are aligned, according to another embodiment of the present invention. The overlay EBG structure illustrated in FIG. 7 can also be applied to a filter.

Referring to FIG. 7, the plurality of plates 102, each connected to one end of a via 103, have different sizes (for example, $A_1 \neq A_2$). Since the frequency characteristics of the overlay EBG structure vary when the plates 102 have different sizes, frequency tuning is possible by varying the sizes of the plates 102.

Figure 8:
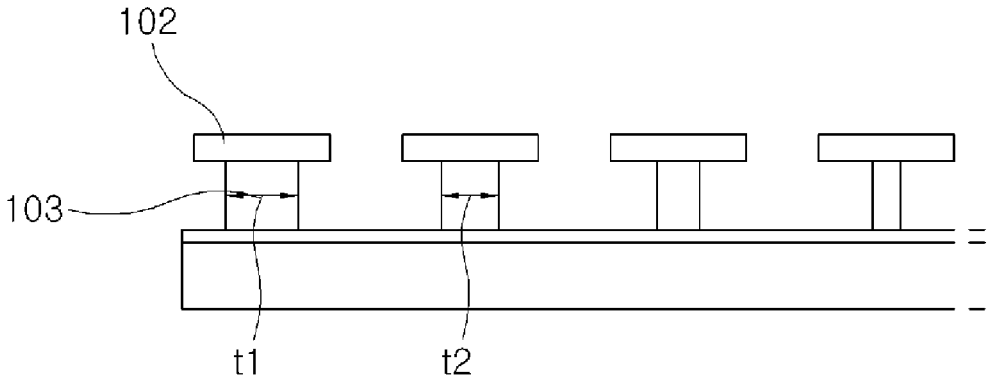
FIG. 8 illustrates an overlay EBG structure in which a plurality of vias having different thicknesses are aligned, according to another embodiment of the present invention.

FIG. 8 illustrates an overlay EBG structure in which a plurality of vias 103 having different thicknesses are aligned, according to another embodiment of the present invention. The overlay EBG structure illustrated in FIG. 8 can also be applied to a filter.

Referring to FIG. 8, the plurality of vias 103, whose one end is connected to a plate 102, have different thicknesses (for example, $t1 \neq t2$). Here, the thickness of the via 103 means a cross-section of the via 103. As described above, since the frequency characteristics of the overlay EBG structure vary when the thickness of the via 103 varies, frequency tuning is possible by varying the thicknesses of the vias 103.

Figure 9:
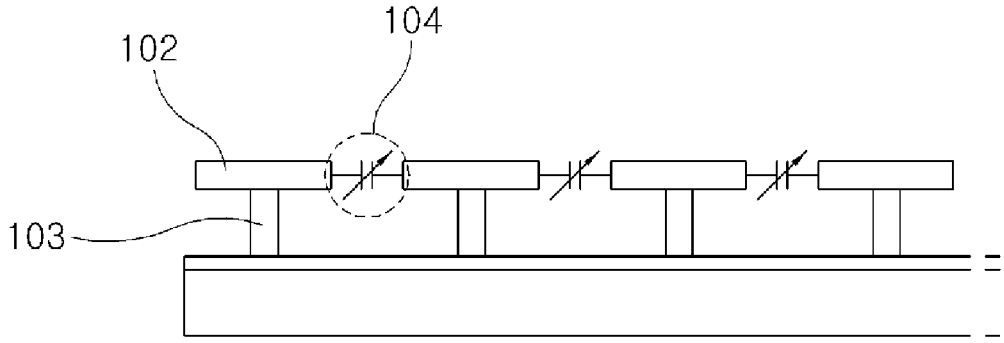
FIG. 9 illustrates an overlay EBG structure in which varactors are respectively inserted between plates, according to another embodiment of the present invention.

FIG. 9 illustrates an overlay EBG structure in which varactors 104 are respectively inserted between plates 102, according to another embodiment of the present invention.

In FIG. 9, the varactors 104 are respectively inserted between the plates 102 which are arranged at intervals. The varactors 104 may be elements (for example, variable capacitance diodes) whose electrostatic fields change according to a voltage applied thereto. Accordingly, since capacitances between the plates 102 are changed by the varactors 104, it is possible to adjust the frequency characteristics of the overlay EBG structure using the varactors 104.

Figure 10:
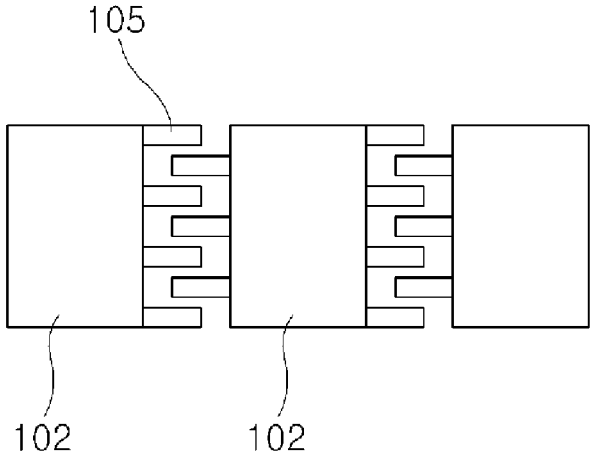
FIG. 10 illustrates an overlay EBG structure in which a plurality of plates having lattice shapes are aligned, according to another embodiment of the present invention.
Figure 11:
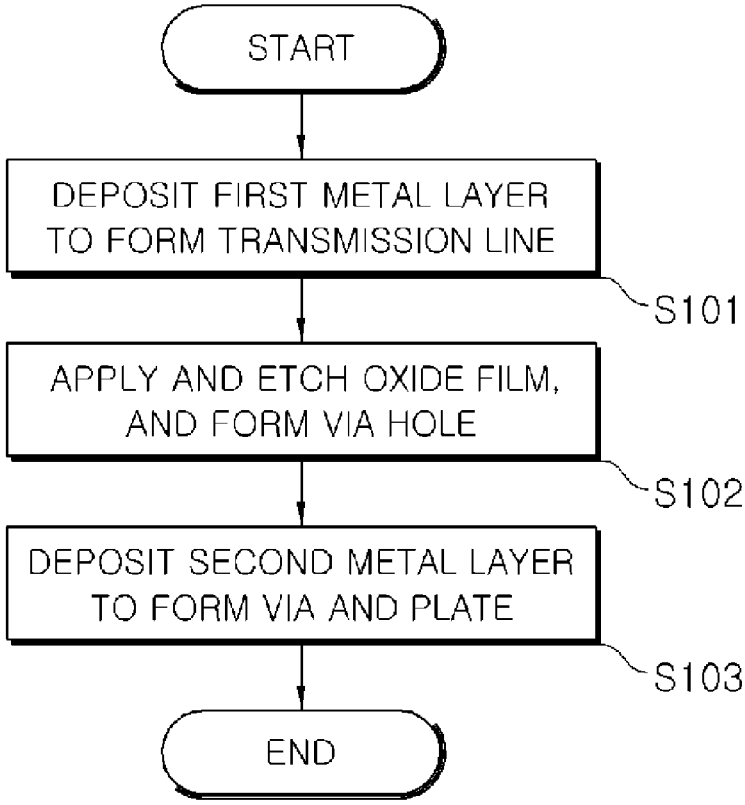
FIG. 11 is a flowchart of a method of manufacturing an overlay EBG structure, according to an embodiment to the present invention.

FIG. 10 illustrates an overlay EBG structure in which a plurality of plates 102 having saw-toothed shapes are aligned, according to another embodiment of the present invention.

Referring to FIG. 10, the facing sides of neighboring plates 102 are formed in an interdigital structure. Here, "interdigital structure" means that a plurality of projection parts are formed in at least one side of each plate 102, and the projection parts of the facing sides of neighboring plates 102 mesh with each other. Since capacitance between the plates 102 varies when the shapes of the plates 102 vary, the frequency characteristics of the overlay EBG structure can be controlled by varying the shape of the plates 102.

As illustrated in FIGS. 6 through 10, the overlay EBG structures according to the embodiments of the present invention can control frequency characteristics by adjusting the dimensions of the units 300 including the plates 102 and the vias 103. Accordingly, the overlay EBG structures can be used as a band stop filter (BSF) which suppresses a specific frequency band, however, the present invention is not limited to this.

Hereinafter, a method of manufacturing an overlay EBG structure according to an embodiment of the present invention, will be described with reference to FIGS. 11 and 12A through 12D. The overlay EBG structure manufacturing method is based on a conventional complementary metal-oxide semiconductor (CMOS) manufacturing process, and details for the CMOS manufacturing process will be omitted.

Figure 12A:
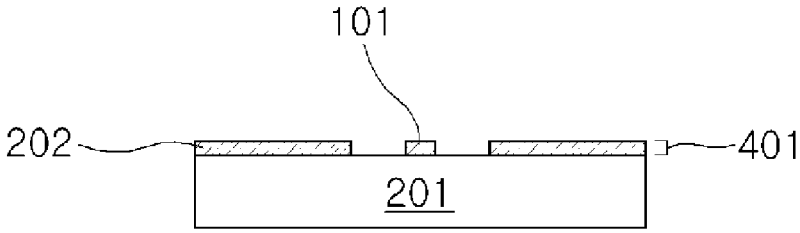
FIGS. 12A through 12D are exemplary views for explaining the overlay EBG structure manufacturing method illustrated in FIG. 11.

In operation S101, a first metal layer 401 is deposited on a substrate 201 to form a transmission line 101 (see FIG. 12A). At this time, ground plates 202 can be formed on the substrate 201 in such a manner that the ground plates 202 are separated from each other with the transmission line 101 in between.

Figure 12B:
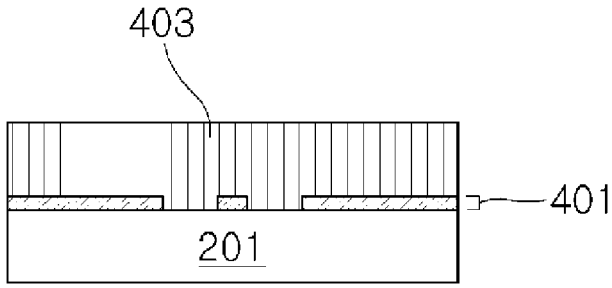
Figure 12C:
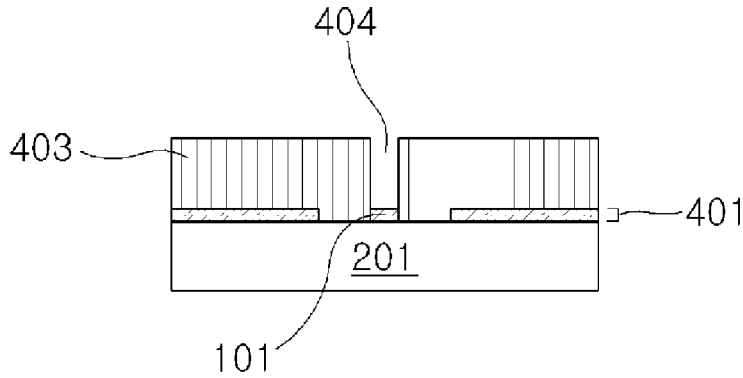

In operation S102, an oxide film 403 is applied on the substrate 201, and etched so that a via hole 404 is formed to expose the transmission line 101 (see FIGS. 12B and 12C). In detail, a via mask is placed on the oxide film 403 and patterned, thereby forming the via hole 404. The via hole 404 is used to form a via 103 that is to be connected to the transmission line 101.

Figure 12D:
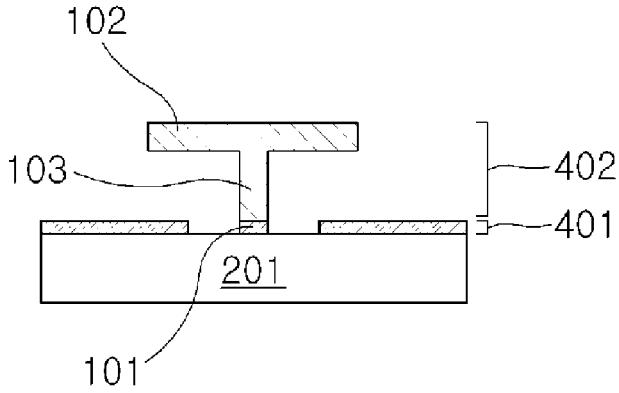

In operation S103, a second metal layer 402 is deposited through the via hole 404 to form a via 103 and a plate 102 (see FIG. 12D). That is, the second metal layer 402 is connected to the transmission line 101 through the via hole 404 to form a via 103 and a plate 102. Here, the via 103 and the plate 102 can be formed at predetermined intervals in a longitudinal direction of the transmission line 101.

In FIG. 12D, the oxide film 403 is removed in order to clearly show the structure according to the current embodiment, but, the oxide film 403 may not be removed.

In this manner, the via 103 and the plate 102, which are extended from the transmission line 10, are formed at predetermined intervals, so that an overlay EBG structure is complete.

As a result, in the overlay EBG structure and the manufacturing method thereof, according to the present invention, as described above, since the vias and plates extend vertically from the transmission line and from the substrate, it is possible to prevent an electromagnetic wave passing through the transmission line from being lost through the substrate, to obtain desired frequency characteristics by adjusting the dimensions of the vias and plates, and to manufacture the overlay EBG structure using an existing CMOS process without having to perform any additional process.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. An overlay electromagnetic bandgap (EBG) structure comprising:

a transmission line which is formed on a substrate, and transmits a signal;

a plurality of plates, each of the plurality of plates is formed over and separated from the transmission line; and a plurality of vias, each of the plurality of vias connects a respective plate of the plurality of plates to the transmission line, wherein the plurality of plates and the plurality of vias are formed at predetermined intervals in a longitudinal direction of the transmission line.

2. The overlay EBG structure of claim 1, wherein frequency characteristics of the overlay EBG structure are controlled by adjusting the predetermined intervals between the plurality of plates.

3. The overlay EGB structure of claim 1, wherein frequency characteristics of the overlay EBG structure are controlled by adjusting sizes of the plurality of plates.

4. The overlay EGB structure of claim 1, wherein frequency characteristics of the overlay EBG structure are controlled by adjusting thicknesses of the plurality of vias.

5. The overlay EGB structure of claim 1, further comprising a plurality of varactors respectively inserted between the plurality of plates, wherein frequency characteristics of the overlay EGB structure are controlled by the plurality of varactors.

6. The overlay EBG structure of claim 1, wherein facing sides of the plurality of plates are formed in an interdigital structure, and mesh with each other.

7. The overlay EBG structure of claim 1, formed on both a front surface and a rear surface of the substrate.

8. The overlay EBG structure of claim 1, wherein the transmission line is a central signal line of a coplanar waveguide (CPW).

9. The overlay EBG structure of claim 1, wherein the transmission line and the plurality of plates are disposed above the substrate on a same side of the substrate.

10. The overlay EBG structure of claim 1, further comprising first and second ground plates extending in the longitudinal direction and disposed on a same side of the substrate as the transmission line such that the transmission line is disposed between the first ground plate and the second ground plate.

11. The overlay EBG structure of claim 10, wherein the plurality of plates are suspended above the substrate, the transmission line, the first ground plate and the second ground plate by the plurality of vias.

12. The overlay EBG structure of claim 11, wherein the transmission line, the plurality of plates, the plurality of vias, the first ground plate and the second ground plate are disposed above the substrate on the same side of the substrate.

13. The overlay EBG structure of claim 11, wherein an electric field is generated vertically between the plurality of plates and the first ground plate, and vertically between the plurality of plates and the second ground plate, when the signal is transmitted through the transmission line.

14. The overlay EBG structure of claim 1, further comprising a first ground plate and a second ground plate disposed on the substrate such that the transmission line is disposed between the first ground plate and the second ground plate, wherein each plate of the plurality of plates has a bottom surface comprising a first end portion, a second end portion and a center portion disposed between the first end portion and the second end portion, each via of the plurality of vias is connected to the center portion of the bottom surface of one of the plurality of plates, the first end portion of the bottom surface of each of the plurality of plates extends over, suspended above, the first ground plate such that a respective first air gap is formed therebetween, and the second end portion of the bottom surface of each of the plurality of plates extends over, suspended above, the second ground plate such that a respective second air gap is formed therebetween.

15. The overlay EBG structure of claim 14, wherein the signal is transmitted from the transmission line to the plurality of plates through the plurality of vias, and a respective electric field is generated vertically between the first end portion of the bottom surface of each of the plurality of plates and the first ground plate, and vertically between the second end portion of the bottom surface of each of the plurality of plates and the second ground plate.

16. The overlay EBG structure of claim 14, wherein the plurality of plates are suspended above the substrate, the transmission line, the first ground plate and the second ground plate by the plurality of vias.

17. The overlay EBG structure of claim 16, wherein the transmission line, the plurality of plates, the plurality of vias, the first ground plate and the second ground plate are disposed above the substrate on a same side of the substrate.

* * * * *